US006357272B1

(12) United States Patent
Sandner

(10) Patent No.: US 6,357,272 B1
(45) Date of Patent: Mar. 19, 2002

(54) METHOD AND DEVICE FOR PRODUCING A TOOTHED WHEEL

(75) Inventor: Christian Sandner, Gmunden (AT)

(73) Assignee: Miba Sintermetall Aktiengesellschaft, Laakirchen (AU)

( * ) Notice: Subject to any disclaimer, the term of this patent is extended or adjusted under 35 U.S.C. 154(b) by 0 days.

(21) Appl. No.: 09/530,336

(22) PCT Filed: Oct. 27, 1998

(86) PCT No.: PCT/AT98/00260

§ 371 Date: Jul. 25, 2000

§ 102(e) Date: Jul. 25, 2000

(87) PCT Pub. No.: WO99/22890

PCT Pub. Date: May 14, 1999

(30) Foreign Application Priority Data

Oct. 27, 1997 (AT) ..... A1836/97

(51) Int. Cl.[7] ..... B21B 19/00

(52) U.S. Cl. ..... 72/91; 72/93; 72/102; 29/893.32

(58) Field of Search ..... 72/91, 93, 102, 72/104, 105; 29/893.32

(56) References Cited

U.S. PATENT DOCUMENTS

| | | | | |
|---|---|---|---|---|
| 1,881,382 A | | 10/1932 | Wildhaber | |
| 3,503,237 A | * | 3/1970 | Marcovitch | 72/91 |
| RE26,914 E | | 6/1970 | Tremblay | |
| 3,552,166 A | * | 1/1971 | Percival | 72/102 |
| 3,872,701 A | | 3/1975 | Tersch | |
| 4,414,780 A | | 11/1983 | Jorgensen | |
| 5,133,204 A | * | 7/1992 | Wenzel | 72/91 |
| 5,307,662 A | * | 5/1994 | Tsuzuki | 72/91 |
| 5,711,187 A | * | 1/1998 | Cole et al. | 29/893.32 |

FOREIGN PATENT DOCUMENTS

| | | | | |
|---|---|---|---|---|
| DE | 1 155 080 | | 10/1963 | |
| DE | 43 17 306 | | 10/1993 | |
| EP | 0 552 272 | | 7/1993 | |
| EP | 0 815 984 | | 1/1998 | |
| FR | 2 175 075 | | 10/1973 | |
| GB | 2 050 908 | | 1/1981 | |
| SU | 1174140 | * | 8/1985 | 72/102 |
| WO | WO92/05897 | | 4/1992 | |

* cited by examiner

*Primary Examiner*—Ed Tolan
(74) *Attorney, Agent, or Firm*—Collard & Roe, P.C.

(57) ABSTRACT

There are described a method and an apparatus for producing a gear wheel from a powder metal blank (1) pressed and sintered with an overmeasure in the toothing area, which powder metal blank is compacted under a plastic deformation in the vicinity of the overmeasure by pressing against a counter-toothing (8) of at least one rotating pressing tool (3) by the overmeasure, which counter-toothing engages in the toothing (9) of the powder metal blank (1). To create advantageous constructional conditions it is proposed that the counter-toothing (8) designed as internal toothing of the annular pressing tool (3) enclosing the powder metal blank (1) is pressed into the toothing (9) of the powder metal blank (1) by means of a pressure roller rolling on the outside periphery (10) of the pressing tool (3).

9 Claims, 3 Drawing Sheets

METHOD AND DEVICE FOR PRODUCING A TOOTHED WHEEL

Figure 1:
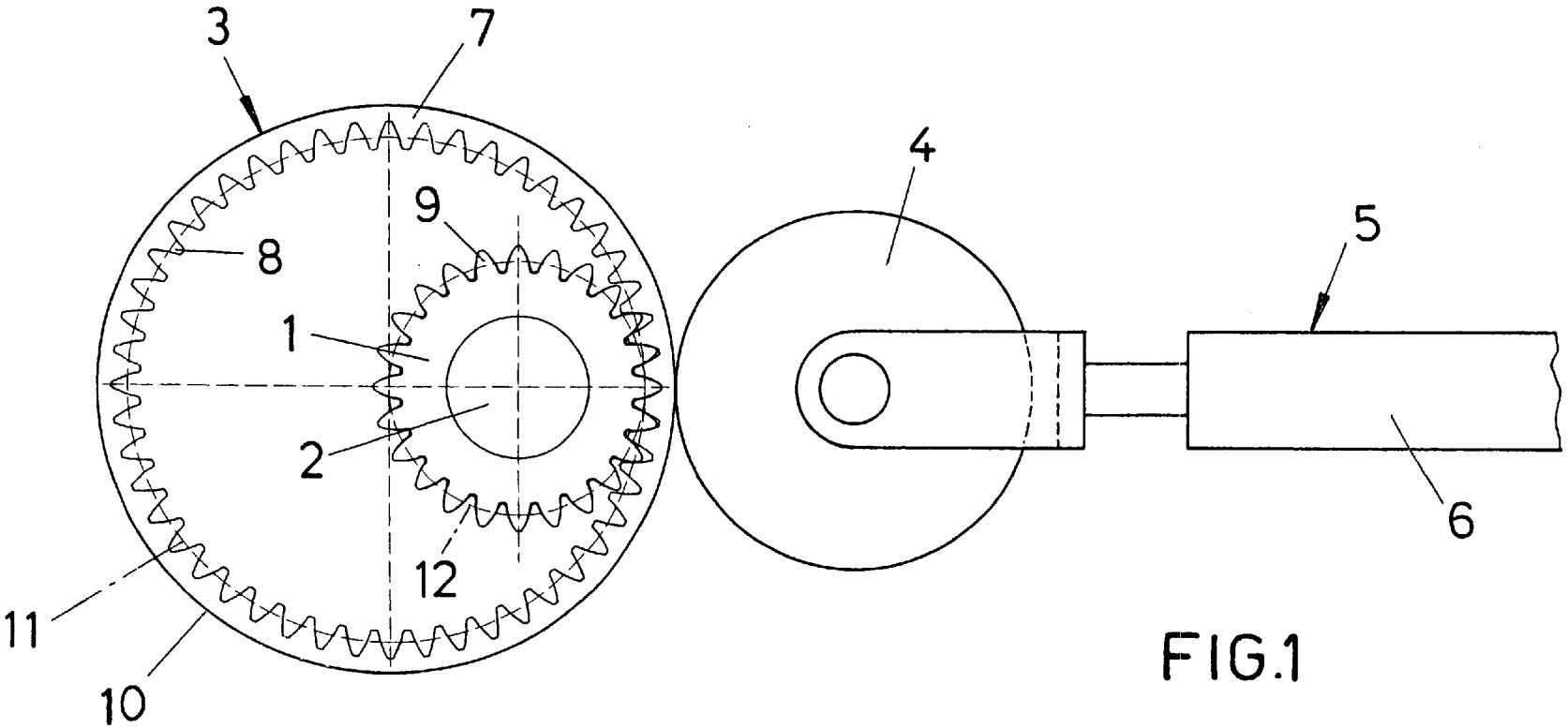

This application is a 35 USC 371 of PCT/AT98/00260 filed Oct. 27, 1998.

This invention relates to a method of producing a gear wheel from a powder metal blank pressed and sintered with an overmeasure in the vicinity of the toothing, which powder metal blank is compacted under a plastic deformation in the vicinity of the overmeasure by pressing against a counter-toothing of at least one rotating pressing tool by the overmeasure, which counter-toothing engages in the toothing of the powder metal blank, and to an apparatus for performing the method.

Due to the porosity of the sintered material, gear wheels pressed and sintered from a metal powder have a comparatively low permanent bending strength in the vicinity of the tooth roots and a low wear resistance in the vicinity of the tooth flanks. To eliminate these disadvantages it is known (EP 0 552 272 B1) to compact the sintered powder metal blanks of the gear wheels in the flank area and in the root area of the teeth such that a largely non-porous surface layer is obtained. This non-porous surface layer in the area of engagement of the gear wheel involves a considerable increase in the admissible load-bearing capacity of sintered gear wheels. The compaction of the surface layer in the area of engagement of the gear wheel is effected via a pressing tool in the form of at least one gear wheel which has an external toothing engaging in the toothing of the powder metal blank. Since the driven gear wheel of the pressing tool is urged against the powder metal blank via a pressing means, the teeth of the powder metal blank are compacted in the area of engagement in several rotations via the counter-toothing of the pressing tool, until the desired contour of the toothing of the sintered gear wheel is achieved. Due to the kinematic conditions, sliding speeds occur between the flanks of the meshing teeth of the powder metal blank and the pressing tool along the line of engagement outside the pitch point during the rolling movement between the toothing of the powder metal blank and the counter-toothing of the pressing tool. This sliding movement, which increases with increasing distance from the pitch point, together with the contact pressure which is applied onto the flanks of the powder metal blank in particular in the vicinity of the tooth tips and tooth roots and is required for the local compaction, leads to a flank load of the powder metal blank which involves the risk of superficial fissures and material chippings in the vicinity of the surface of the tooth flanks and tooth roots of the powder metal blank. Such surface impairments involve, however, a considerable reduction of the load-bearing capacity of the sintered gear wheel which is compacted at the surface in the area of engagement. To avoid the harmful influences of the sliding movements of two flanks of meshing teeth it is known to use a lubricant to reduce the sliding friction, but the use of lubricants in the compaction of sintered powder metal blanks is prohibited, because the lubricant penetrating into the pores impairs or prevents the compaction of the material.

It is therefore the object underlying the invention to improve a method as described above with simple means such that the teeth of the powder metal blank can sufficiently be compacted in the area of engagement without having to fear an impairment of the compacted surface in particular in the vicinity of the tooth tips or tooth roots.

This object is solved by the invention in that the counter-toothing designed as internal toothing of the annular pressing tool enclosing the powder metal blank is pressed into the toothing of the powder metal blank by means of a pressure roller rolling on the outside periphery of the pressing tool.

The invention utilizes the fact that in the case of an internal toothing the sliding speeds between the tooth flanks of the powder metal blank and of the pressing tool, which occur during tooth engagement, are distinctly lower than in the case of a tooth engagement between two spur gears. This means that when using an annular pressing tool with an internal toothing as counter-toothing for the powder metal blank the load acting on the teeth of the powder metal blank can be restricted to a degree which excludes superficial fissures and material chippings in the vicinity of the tooth tips and tooth roots despite the necessary compaction in the area of engagement. The pressing force required for compaction is applied by a pressure roller which rolls on the outside periphery of the pressing tool, so that the compaction in the area of engagement can again be effected in several rotations, when the compaction in one rotation is not sufficient.

When a number of teeth larger than the number of teeth of the toothing of the powder metal blank is chosen for the internal toothing of the pressing tool, the internal toothing of the pressing tool is rolled over the toothing of the powder metal blank, while the pressing tool is continuously pressed onto the toothing of the powder metal blank, with the related sliding movement between the flanks rolling on each other decreasing with decreasing difference of the number of teeth of the pressing tool and of the powder metal blank. Accordingly, particularly favorable conditions are obtained in this connection when, with the same number of teeth of the internal toothing of the pressing tool and of the toothing of the powder metal blank, the pressing tool enclosing the powder metal blank with a clearance is continuously urged against the powder metal blank without a relative rotation between pressing tool and powder metal blank in peripheral direction. However, such compaction method requires a perfect pressing tool, because a defect in the vicinity of a tooth of the pressing tool is completely reproduced on a tooth of the powder metal blank without a possibility of compensation by the engagement of other teeth.

Despite the internal toothing, the same number of teeth of the pressing tool and of the powder metal blank provides for the simultaneous compaction of the toothing of the powder metal blank on two or more points distributed over the periphery, because the pressing tool can be urged against the powder metal blank at two or more points under an elastic deformation. Between the pressing tool and the powder metal blank there should merely be provided a slight initial clearance, which allows the pressing tool to be slipped onto the powder metal blank and correspondingly increases with increasing compaction of the tooth surfaces of the powder metal blank.

The possible compaction of the teeth of the powder metal blank in the vicinity of the intended overmeasure depends on the respective solidification of the material, which in the case of a cold working of the powder metal blank during a calibration process preceding the compaction or during the compaction of the tooth surfaces itself is obtained in the vicinity of the overmeasure. To be able to obtain a sufficient surface compaction even under more difficult conditions of compaction, the powder metal blank may be subjected to a heat treatment prior to compaction or between two compaction operations, in order to correspondingly reduce the deformation resistance for the subsequent compaction.

As has already been mentioned above, the harmful effects of the sliding movement of two flanks of meshing teeth can be reduced by using a lubricant. To be able to utilize the advantages of the lower sliding friction obtained by the use of a lubricant during the compaction of the tooth surfaces in the area of engagement, without impairing the compaction of the toot surfaces of the powder metal blank by lubricant penetrating into the pores, the powder metal blank can finally be compacted by using a lubricant after a precompaction. Precompaction should be effected to an extent which results in a substantial closure of the surface pores, so that during the use of the lubricant a penetration of the lubricant into surface pores, which is harmful for the further compaction, can be excluded.

For performing the method an apparatus can be employed which is provided with a take-up shaft for the powder metal blank, a pressing tool, which with a counter-toothing engages in the toothing of the powder metal blank, and with a means for pressing the pressing tool against the powder metal blank. In such apparatus, the pressing tool which comprises an inner gear rim enclosing the powder metal blank is guided between the powder metal blank and a pressure roller of the pressing means, which pressure roller is axially parallel to the powder metal blank. The inner gear rim of the pressing tool acts as pressure transmitting member between the pressure roller and the powder metal blank, so that the pressing tool is loaded merely in the area of engagement, which has an advantageous influence on the service life of the pressing tool.

As has already been explained, particularly advantageous load conditions are obtained when the inner gear rim of the pressing tool and the toothing of the powder metal blank have the same number of teeth, the pressing tool enclosing the powder metal blank with a clearance, in order to facilitate inserting the powder metal blank into the pressing tool or slipping the pressing tool onto the powder metal blank. When in such embodiment the pressing means has at least two pressure rollers arranged preferably rotationally symmetrical with respect to the take-up shaft of the powder metal blank, at least two compaction steps can be performed during one rotation, but only when the inner gear rim of the pressing tool permits a corresponding elastic deformation via the pressure rollers. The rotationally symmetrical arrangement of the pressure rollers avoids the dissipation of part of the compaction pressure via the bearing of the take-up shaft.

Figure 2:
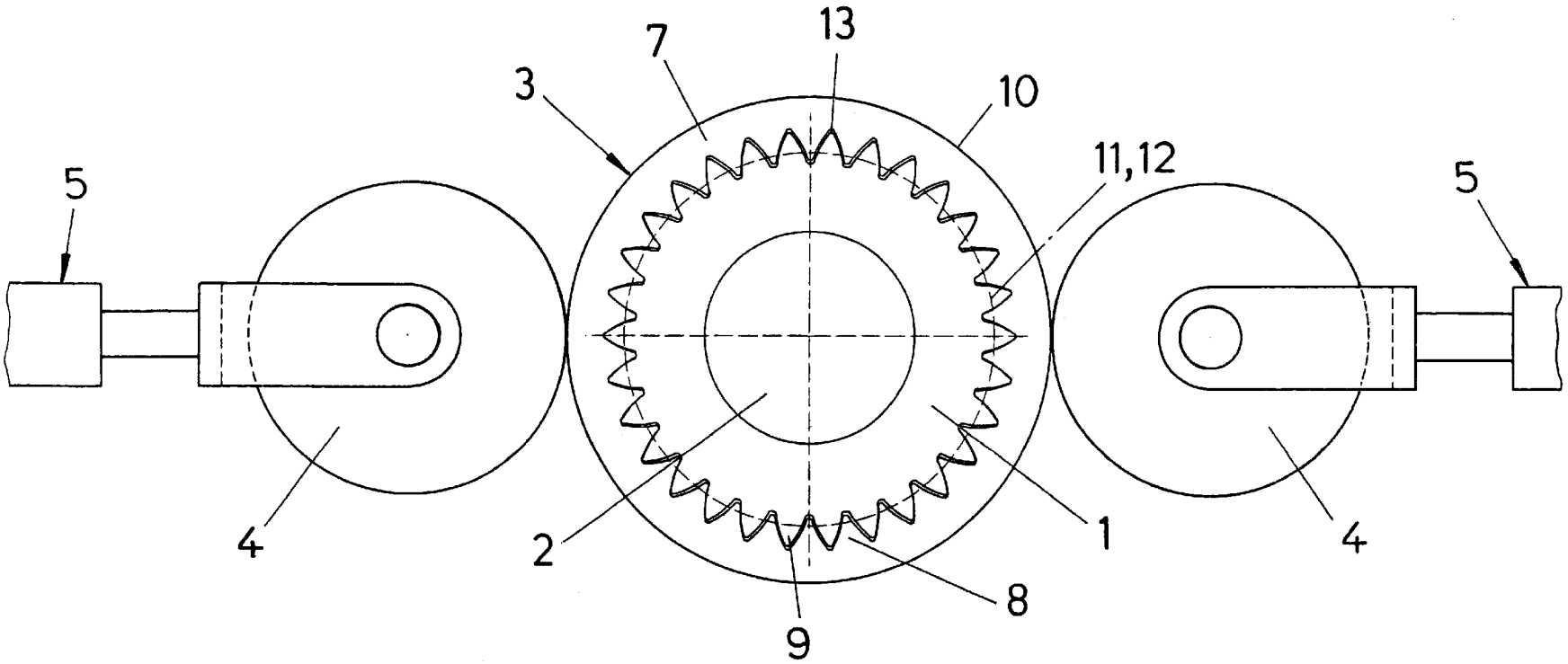
Figure 3:
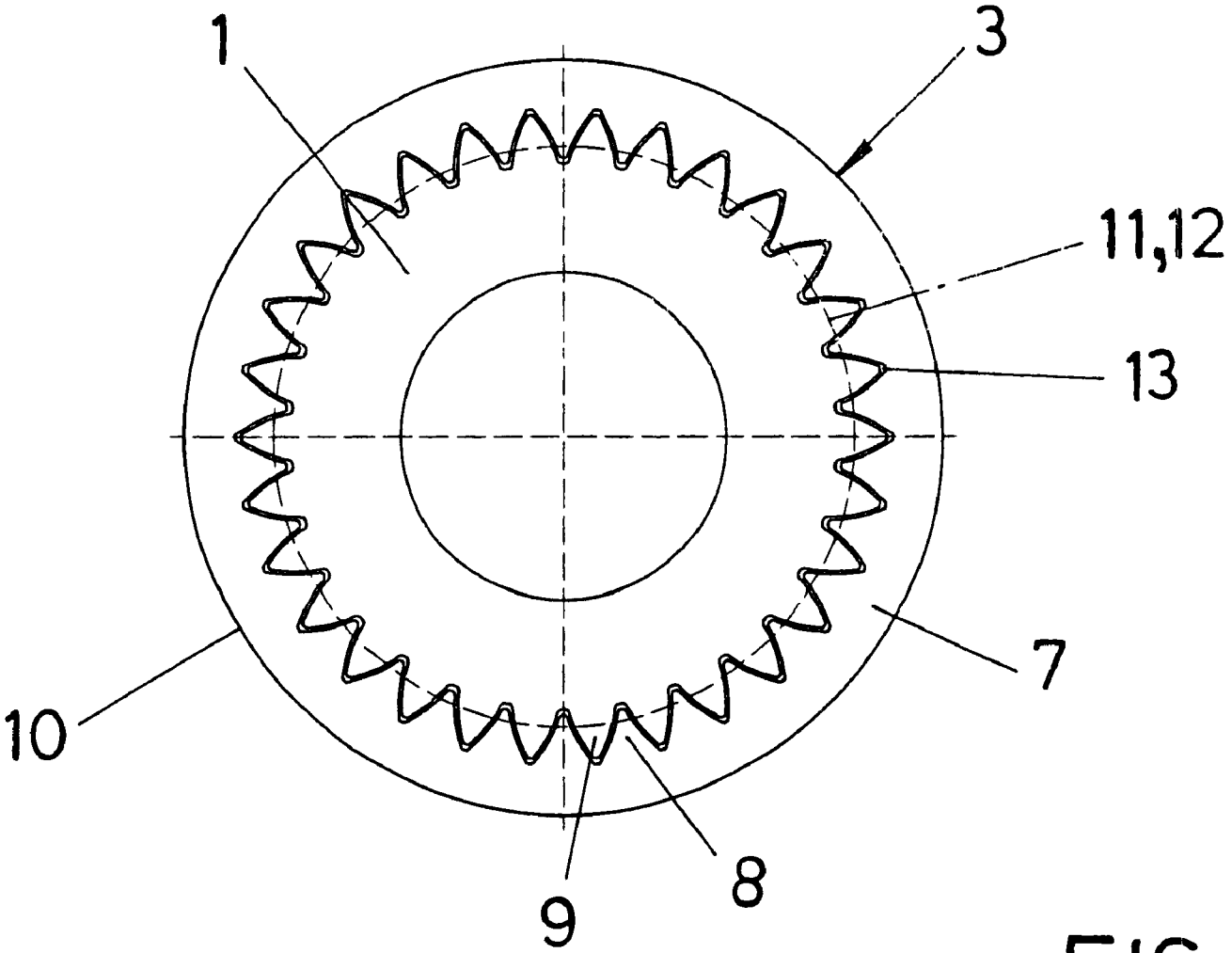

The inventive method will now be explained with reference to the drawing, wherein:

FIG. 1 shows an inventive apparatus for producing a gear wheel from a pressed and sintered powder metal blank in a schematic side view, FIG. 2 shows an embodiment of an inventive apparatus, which is modified as compared to FIG. 1, likewise in a schematic side view, and FIG. 3 shows a gear wheel produced in accordance with FIG. 2, which is compacted at the tooth surface in the area of engagement, prior to removal from the pressing tool.

In accordance with the embodiment shown in FIG. 1, the powder metal blank 1 to be machined is clamped on a take-up shaft 2, before the pressing tool 3 is urged against the powder metal blank 1 by means of a pressure roller 4 via a pressing means 5, for instance via a hydraulic cylinder 6 to be pressurized with a predetermined pressure. In contrast to known apparatuses of this kind, the pressing tool 3 is comprised of an inner gear rim 7 which forms a counter-toothing 8 for the toothing 9 of the powder metal blank 1. The pressure roller 4 of the pressing tool 5 rolls on the outside periphery 10 of the inner gear rim 7, the teeth of the counter-toothing 8 being pressed into the tooth spaces of the toothing 9 of the powder metal blank 1. Since the teeth of the powder metal blank 1 were sintered with a corresponding overmeasure in the area of flank and root, but the teeth of the counter-toothing 8 of the pressing tool 3 correspond for instance to the nominal size of the teeth of the toothing 9 of the finished gear wheel, the tooth flanks or the tooth roots are compacted under a plastic deformation in the area of the over-measure by the pressed teeth of the pressing tool 3. Compaction is effected step by step, because the powder metal blank 1 is driven via the take-up shaft 2, so that the powder metal blank 1 rolls in the counter-toothing 8 of the pressing tool 3, which is guided between the powder metal blank 1 and the pressure roller 4. Since the toothing 9 of the powder metal blank 1 cooperates with a counter-toothing 8 in the form of an internal toothing, the sliding speeds between the flanks and counter-flanks of meshing toothings 8, 9 in the vicinity of the line of engagement outside the pitch point can be restricted to an extent which excludes superficial fissures or material chippings in the vicinity of the compacted tooth surfaces of the powder metal blank 1, all the more so as due to the concave flanks of the counter-toothing 8 of the pressing tool 3 as compared to an external toothing as counter-toothing more favorable conditions are obtained as regards the pressure load acting on the toothing 9 of the powder metal blank 1.

As can directly be taken from FIG. 1, the sliding movement between the tooth flanks of the toothing 9 of the powder metal blank 1 and the counter-toothing 8 of the pressing tool 3 depends on the ratio of the diameters of the pitch circles 11, 12 of the pressing tool 3 and of the powder metal blank 1. The smaller the difference in diameter, the more favorable compaction conditions are obtained in the area of engagement of the two toothings 8 and 9. To be able to exclude a rolling movement at all, the number of teeth of the pressing tool 3 and of the powder metal blank 1 may be the same, as is represented in FIG. 2. In this case, the pressing tool 3 is merely urged against the toothing 9 of the powder metal blank 1 in the vicinity of a pressure roller 4, the pitch circles 11, 12 substantially coinciding. To be able to put the pressing tool 3 onto the powder metal blank 1, a clearance 13 must be provided between the toothings 8 and 9, which clearance is overcome when a pressure roller 4 is set against the inner gear rim 7. When corresponding to the embodiment shown in FIG. 2 not only one, but at least two opposing pressure rollers 4 are used, a compaction of the teeth of the toothing 9 of the powder metal blank 1 in the vicinity of the two pressure rollers 4 is only possible with a plastic deformation of the pressing tool 3, which is expanded transverse to the application of pressure by the pressure rollers 4 with the effect that the clearance between the toothings 8 and 9 increases with increasing distance from the pressure rollers 4. The surface compaction of the toothing 9 of the powder metal blank 1 is in turn effected in several rotations, whose number can, however, merely be reduced correspondingly in the vicinity of a peripheral point as compared to a compaction. Since due to the compaction of the tooth flanks or tooth roots the clearance 13 between the toothing 9 of the powder metal blank 1 and the counter-toothing 8 of the pressing tool 3 is increased, a removal of the finished gear wheel from the pressing tool 3 is easily possible.

The invention is of course not restricted to the represented embodiments. The compaction in the vicinity of the tooth flanks or tooth roots of the toothing 9 of the powder metal blank might for instance be performed by means of two or more different pressing tools, in order to ensure certain compaction conditions by means of the respectively particular configuration of the counter-toothing of the individual pressing tools. Moreover, the powder metal blank might be exposed to an intermediate treatment between two compaction steps, for instance by abrasive blasting, brushing or a heat treatment, which possibly provides for particularly advantageous starting conditions for the respectively subsequent pressing operation. After a corresponding surface compaction, the further compaction may also be effected by using a lubricant.

What is claimed is:

1. A method of producing a gear wheel having a peripheral toothing from a powder metal blank pressed and sintered with an overmeasure in the area of the toothing, which comprises the steps of (a) rotating an annular pressing tool having an internal counter-toothing around the powder metal blank while the counter-toothing engages the toothing, and (b) rolling a pressure roller on an outer periphery of the pressing tool to press the counter-toothing against the toothing and to compact the overmeasure under plastic deformation.

2. The method of claim 1, wherein the internal counter-toothing of the annular pressing tool is rolled on the toothing of the powder metal blank while the counter-toothing is continuously pressed against the toothing.

3. The method of claim 1, wherein the internal counter-toothing and the toothing have the same number of teeth, and the counter-toothing of the pressing tool surrounds the toothing of the powder metal blank with a clearance while the counter-toothing is continuously pressed against the toothing without a relative rotation between the pressing tool and the powder metal blank in a peripheral direction.

4. The method of claim 3, wherein the pressing tool is pressed against the powder metal blank on at least two points spaced from each other on the outer periphery.

5. The method of claim 1, wherein the powder metal blank is subjected to a heat treatment before compaction.

6. An apparatus for producing a gear wheel having a peripheral toothing from a powder metal blank pressed and sintered with an overmeasure in the area of the toothing, which comprises (a) a take-up shaft for mounting the powder metal blank, (b) an annular pressing tool surrounding the take-up shaft and having an internal counter-toothing surrounding the powder metal blank, and (b) a pressure roller at an outer periphery of the pressing tool for pressing the counter-toothing against the toothing and to compact the overmeasure under plastic deformation, the take-up shaft and the pressure roller having axes extending parallel to each other.

7. The apparatus of claim 6, wherein the internal counter-toothing of the pressing tool and the toothing of the metal powder blank have the same number of teeth, and the annular pressing tool surrounds the take-up shaft with a clearance between the counter-toothing and the toothing.

8. The apparatus of claim 6, comprising two pressure rollers at the outer periphery of the pressing tool.

9. The apparatus of claim 8, wherein the pressure rollers are arranged rotationally symmetrical with respect to the take-up shaft.

* * * * *

UNITED STATES PATENT AND TRADEMARK OFFICE

CERTIFICATE OF CORRECTION

PATENT NO. : 6,357,272 B1
DATED : March 19, 2002
INVENTOR(S) : Sandner

It is certified that error appears in the above-identified patent and that said Letters Patent is hereby corrected as shown below:

Title page,
Item [30], the priority date correctly should read: -- October 30, 1997 --

Signed and Sealed this

Twenty-fourth Day of September, 2002

*Attest:*

*Attesting Officer*

JAMES E. ROGAN
*Director of the United States Patent and Trademark Office*